US005414948A

United States Patent [19]

Kudo

[11] Patent Number: 5,414,948

[45] Date of Patent: May 16, 1995

[54] DISK HOLDER

[76] Inventor: Kenneth M. Kudo, P.O. Box 1214, Pahoa, Hi. 96778

[21] Appl. No.: 138,425

[22] Filed: Oct. 20, 1993

[51] Int. Cl.[6] ..... G09F 3/12; G09F 3/14; G09F 3/20

[52] U.S. Cl. ..... 40/651; 40/642; 40/653; 40/661; 63/19; 63/20; 63/23; 63/1.1

[58] Field of Search ..... 63/18, 19, 20, 23, 1.1; 40/642, 651, 653, 661, 152, 158.1

[56] References Cited

U.S. PATENT DOCUMENTS

| | | | |
|---|---|---|---|
| 369,871 | 9/1887 | Morrill | 63/18 |
| 686,197 | 11/1901 | Bippart | 63/23 |
| 1,246,369 | 11/1917 | Winans | 40/642 |
| 4,984,683 | 1/1991 | Eller | 63/19 |

FOREIGN PATENT DOCUMENTS

| | | | |
|---|---|---|---|
| 0197522 | 10/1986 | European Pat. Off. | 40/152 |
| 0865254 | 2/1953 | Germany | 40/642 |
| 0002467 | 5/1910 | United Kingdom | 40/642 |
| 0181582 | 6/1922 | United Kingdom | 40/152 |

*Primary Examiner*—Edward K. Look
*Assistant Examiner*—Christopher Verdier
*Attorney, Agent, or Firm*—Michael I. Kroll

[57] ABSTRACT

A disk holder is provided for a cardboard disk having decorative indicia printed thereon. The holder consists of a circular case having a first aperture therethrough. A structure is for maintaining the disk within the first aperture in the circular case. A bezel is provided having a second aperture therethrough. The bezel extends about the front of the circular case. The decorative indicia on the disk can be viewed through the second aperture in the bezel within the circular case.

7 Claims, 2 Drawing Sheets

DISK HOLDER

BACKGROUND OF THE INVENTION

1. Field of the Invention

The instant invention relates generally to lockets and more specifically it relates to a disk holder.

2. Description of the Prior Art

Numerous lockets have been provided in prior art that are adapted to be small ornamental cases for pictures or keepsakes, usually worn as pendants which are attached to necklaces and suspended therefrom. While these units may be suitable for the particular purpose to which they address, they would not be as suitable for the purposes of the present invention as heretofore described.

SUMMARY OF THE INVENTION

A primary object of the present invention is to provide a disk holder that will overcome the shortcomings of the prior art devices.

Another object is to provide a disk holder that is structured to retain a cardboard disk which has decorative indicia printed thereon, so as to service as a picture frame for the cardboard disk.

An additional object is to provide a disk holder that services as a brooch to be attached to a garment and as well as a pendant, so that it can be hung from a chain to be worn about a neck of a person.

A further object is to provide a disk holder that is simple and easy to use.

A still further object is to provide a disk holder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
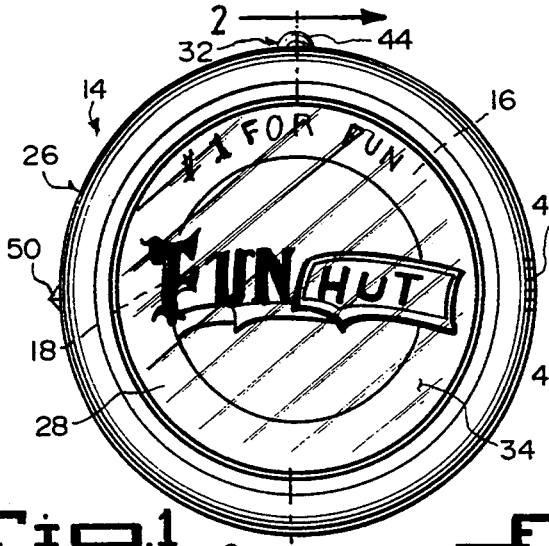
FIG. 1 is a front view of a first embodiment of the instant invention.

Turning now descriptively to the drawings, in which similar reference characters denote similar elements throughout the several views, FIGS. 1 through 12 illustrate a disk holder 14 for a cardboard disk 16, having decorative indicia 18 printed thereon. The holder 14 consists of a circular case 20 having a first aperture 22 therethrough. A structure 24 is for maintaining the disk 16 within the first aperture 22 in the circular case 20. A bezel 26 is provided, having a second aperture 28 therethrough. The bezel 26 extends about the front of the circular case 20. The decorative indicia 18 on the disk 16 can be viewed through the second aperture 28 in the bezel 26 within the circular case 20.

Figure 3:
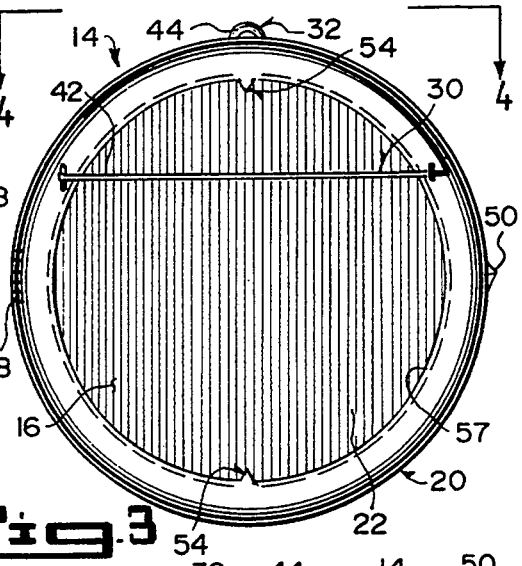
FIG. 3 is a rear view taken in the direction of arrow 3 in FIG. 2.
Figure 1A:
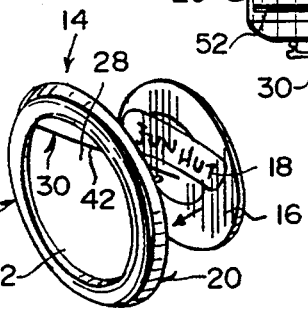
FIG. 1A is a perspective view of a second embodiment of the instant invention.
Figure 4:
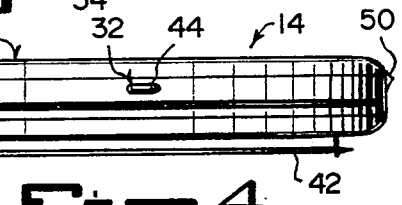
FIG. 4 is a top view taken in the direction of arrows 4—4 in FIG. 3.
Figure 10:
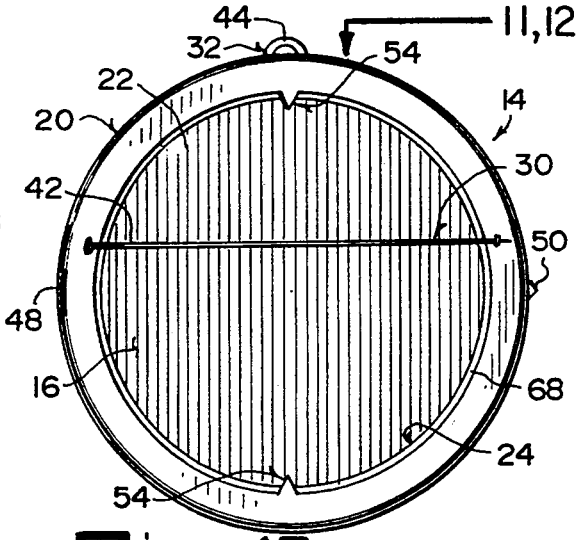
FIG. 10 is a rear view taken in the direction of arrow 10 in FIG. 9.
Figure 11:
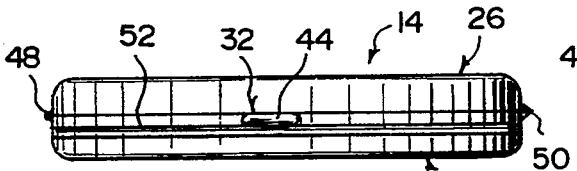
FIG. 11 is a top view taken in the direction of arrow 11 in FIG. 10.
Figure 12:
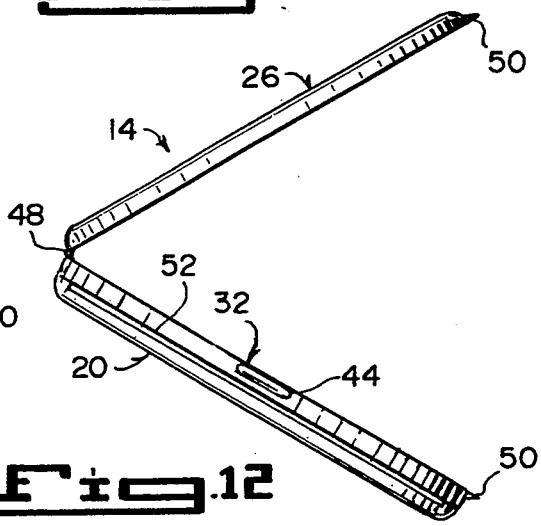
FIG. 12 is a top view taken in the direction of arrow 12 in FIG. 10 in an opened position.

A component 30, as shown in FIGS. 1A, 3, and 10 is for attaching the circular case 20 to a garment, so that it can function as a brooch. An element 32, as shown in FIGS. 1, 2, 3, 4, 5, 8, 10, and 12 is for attaching the circular case 20 to a chain, so that it can function as a pendant to be worn about a neck of a person.

A crystal 34 can also be provided, with a structure 36 for maintaining the crystal 34 between the circular case 20 and the bezel 26. The crystal will protect the disk 16, while allowing the disk to be viewed therein (see FIGS. 2 and 9).

Figure 2:
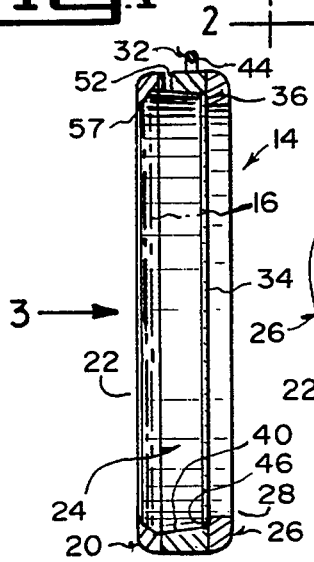
FIG. 2 is a cross sectional view taken along line 2—2 in FIG. 1.
Figure 5:
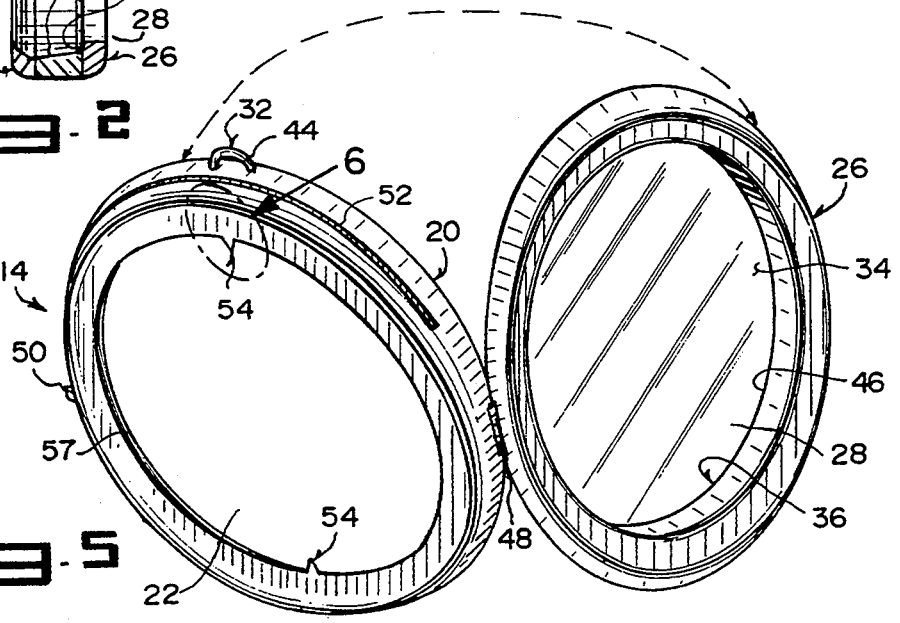
FIG. 5 is a perspective view of the first embodiment in an opened position.

The disk maintaining structure 24, as shown in FIGS. 2, 3 and 5 includes an inner annular wall 40 of the first aperture 22 tapering inwardly in a reduced diameter. The disk 16 can be maintained in the first aperture 22 by a tight compression fit to the inner annular wall 40.

The garment attaching component 30 is a safety pin 42, mounted to the back of the circular casing 20. The chain attaching element 32 is a loop 44, mounted to the top of the circular casing 20. The crystal maintaining structure 36 consists of the first aperture 22 in the circular case 20 being of a larger diameter then the second aperture 28 in the bezel 26. An annular step 46 is formed between the first aperture 22 in the circular case 20 and the second aperture 28 in the bezel 26. An edge of the crystal 34 can be secured to the annular step 46.

A hinge 48 is on one side between the circular case 20 and the bezel 26. A catch 50 is on an opposite side between the circular case 20 and the bezel 26. The bezel 26 can open to allow the disk 16 and crystal 34 to be inserted and sandwiched between the circular case 20 and the bezel 26, so that a disk 16 and crystal 34 of a grossly larger diameter than the first aperture 22 can be accommodated.

The circular case 20 can also have a slot 52 within the top, so that a disk 16 of a slightly larger diameter than the first aperture 22 can be inserted through the slot 52 and into the first aperture 22 in the circular case 20.

Figure 6:
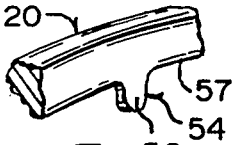
FIG. 6 is an enlarged perspective view as indicated by arrow 6 in FIG. 5, showing a stationary restrictive member.

A plurality of restrictive members 54 can be about the first aperture 22 in the back of the circular case 20, to maintain the disk 16 in the circular case 20 should it become dislodged from the tight compression fit. Each restrictive member 54, as best seen in FIG. 6, can be a stationary protrusion 56 formed from the back of the circular case 20 and extends into the first aperture 22. Each restrictive member 54 can be an annular lip 57, formed about a rear edge of the first aperture 22 in the circular case 20. Each restrictive member 54 can be a second disk 16, inserted behind the first disk 16, into the first aperture 22 and maintained by the tight compression fit of the inner annular wall 40.

Figure 7:
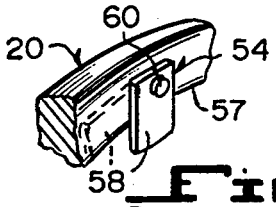
FIG. 7 is an enlarged perspective view similar to FIG. 6, showing a first type of moveable restrictive member.
Figure 7A:
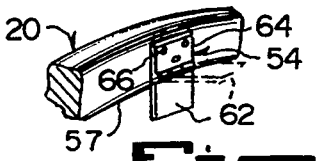
FIG. 7A is an enlarged perspective view similar to FIG. 7, showing a second type of moveable restrictive member.

Each restrictive member 54, as best seen in FIG. 7, can be a plate 58 and a pivot pin 60 extending through one end of the plate 58 and into the back of the circular case 20. The plate 58 can pivot down into the first aperture 22. Each restrictive member 54, as best seen in FIG. 7A, can be a plate 62, having a hinged portion 64. Fasteners 66 extend through the hinged portion 64 and into the back of the circular case 20. The plate 62 can fold down into the first aperture 22.

Figure 9:
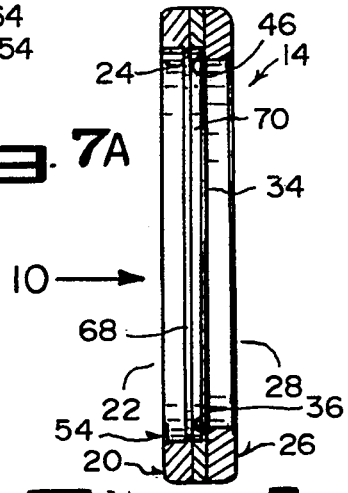
FIG. 9 is a cross sectional view taken along line 9—9 in FIG. 8.
Figure 8:
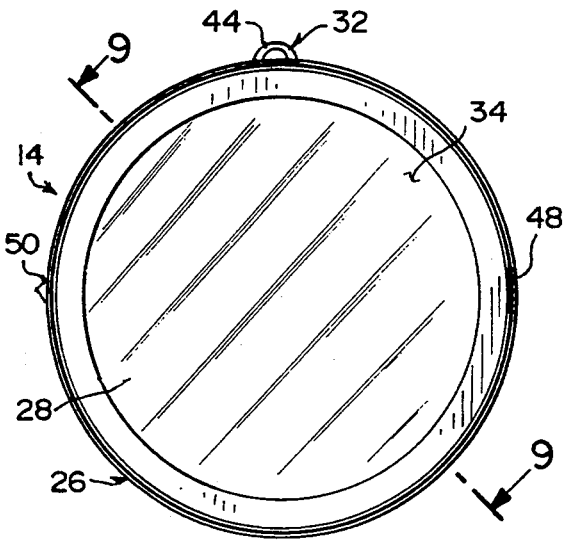
FIG. 8 is a front view of a third embodiment of the instant invention.

A modification is shown in FIGS. 9 and 10, in which the disk maintaining structure 24 includes an inner annular rib 68, within the first aperture 22, to form an annular compartment 70 in the circular case 20. The disk 16 can be maintained in the annular compartment 70 between the annular rib 68 and the crystal 34.

LIST OF REFERENCE NUMBERS

14 disk holder
16 cardboard disk
18 decorative indicia on 16
20 circular case
22 first aperture in 20
24 disk maintaining structure in 22
26 bezel
28 second aperture in 26
30 garment attaching component
32 chain attaching element
34 crystal
36 crystal maintaining structure
40 inner annular wall
42 safety pin for 30
44 loop for 32
46 annular step for 36
48 hinge between 20 and 26
50 catch between 20 and 26
52 slot in 20
54 restrictive member
56 stationary protrusion
57 annular lip
58 plate
60 pivot pin
62 plate
64 hinged portion of 62
66 fastener
68 inner annular rib in 22
70 annular compartment between 68 and 34

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A disk holder for a cardboard disk having decorative indicia printed on said cardboard disk, said holder comprising:

a) a circular case having a first aperture therethrough;

b) means for maintaining the disk within said first aperture in said circular case, said disk maintaining means including an inner annular wall of said first aperture tapering inwardly in a reduced diameter, so that the disk is maintained in said first aperture by a compression fit to said inner annular wall, said disk maintaining means further including an inner annular rib within said first aperture, to form an annular compartment in said circular case, so that the disk is maintained in said annular compartment between said annular rib and said crystal;

c) a bezel having a second aperture therethrough, said bezel extending about the front of said circular case, so that the decorative indicia on the disk is viewed through said second aperture in said bezel within said circular case;

d) means for attaching said circular case to a garment, so that said circular case functions as a brooch, said garment attaching means is a safety pin mounted to the back of said circular casing;

e) means for attaching said circular case to a chain, so that said circular case functions as a pendant worn about a neck of a person, said chain attaching means is a loop mounted to the top of said circular casing;

f) means for maintaining said crystal between said circular case and said bezel, so that said crystal will protect the disk while allowing the disk to be viewed therein, said crystal maintaining means including said first aperture in said circular case being of a larger diameter than said second aperture in said bezel, so as to form an annular step between said first aperture in said circular case and said second aperture in said bezel, whereby an edge of said crystal is secured to said annular step.

g) a hinge located between said circular case and said bezel, said circular case having a slot within the top, so that a disk of a slightly larger diameter than said first aperture can be inserted through said slot and into said first aperture in said circular case; and h) a catch on an opposite side from said hinge between said circular case and said bezel, so that said bezel opens to allow the disk and said crystal to be inserted and sandwiched between said circular case and said bezel.

2. A disk holder as recited in claim 1, further including a plurality of restrictive members about said first aperture in the back of said circular case to maintain the disk in said circular case, should said disk become dislodged from its compression fit.

3. A disk holder as recited in claim 2, wherein each said restrictive member is a stationary protrusion formed from the back of said circular case and extending into said first aperture.

4. A disk holder as recited in claim 2, wherein each said restrictive member is an annular lip formed about a rear edge of said first aperture in said circular case.

5. A disk holder as recited in claim 2, wherein each said restrictive member is a second disk inserted behind the first disk, into said first aperture and maintained by the compression fit of said inner annular wall.

6. A disk holder as recited in claim 2, wherein each said restrictive member includes:

a) a plate; and b) a pivot pin extending through one end of said plate and into the back of said circular case, so that said plate pivots down into said first aperture.

7. A disk holder as recited in claim 2, wherein each said restrictive member includes:

a) a plate having a hinged portion; and b) fasteners extending through said hinged portion and into the back of said circular case, so that said plate folds down into said first aperture.

* * * * *